US005098561A

United States Patent [19]

Grabbe

[11] Patent Number: 5,098,561

[45] Date of Patent: Mar. 24, 1992

[54] MACHINE FOR INTERCEPTING SOLID CONSTITUENTS IN LIQUID STREAMS

[75] Inventor: Wolfgang Grabbe, Wunstorf, Fed. Rep. of Germany

[73] Assignees: Berthold Schreiber; Erhard Schreiber, both of Hanover, Fed. Rep. of Germany

[21] Appl. No.: 644,836

[22] Filed: Jan. 23, 1991

[30] Foreign Application Priority Data

Jan. 23, 1990 [DE] Fed. Rep. of Germany ..... 4001859

[51] Int. Cl.[5] ..... E03F 5/14; E02B 5/08

[52] U.S. Cl. ..... 210/155; 210/159; 210/162; 210/357; 210/413; 198/774.1

[58] Field of Search ..... 210/154, 155, 158, 159, 210/162, 357, 359, 391, 413; 198/774.1

[56] References Cited

U.S. PATENT DOCUMENTS

| | | | |
|---|---|---|---|
| 1,698,387 | 1/1929 | Broome | 210/154 |
| 1,751,421 | 3/1930 | Reid | 210/154 |
| 1,751,422 | 3/1930 | Reid | 210/154 |
| 1,773,576 | 8/1930 | Downes | 210/154 |
| 4,411,586 | 10/1983 | Zitser et al. | 198/774.1 |
| 4,853,116 | 8/1989 | Wallander | 210/155 |
| 5,032,262 | 7/1991 | Wallander | 210/155 |

FOREIGN PATENT DOCUMENTS 436416 12/1984 Sweden .

*Primary Examiner*—Ivars Cintins
*Assistant Examiner*—Christopher Upton
*Attorney, Agent, or Firm*—Peter K. Kontler

[57] ABSTRACT

A machine for intercepting solid constitutents in a liquid stream, such as sewage, has a frame which carries a downwardly sloping screen positionable in and across the stream so that the liquid flows through but the outer side of the upwardly and forwardly sloping screen intercepts solid constituents. The screen has a stationary grate with parallel grate bars extending from the lower to the upper end of the screen, and a mobile grate with parallel grate bars which alternate with the grate bars of the stationary grate. The mobile grate is repeatedly movable forwardly of the stationary grate to lift off the stationary grate bars those solid constitutents which were intercepted by the two sets of grate bars, and the mobile grate is then moved upwardly to raise the lifted solid constituents along the outer side of the stationary grate prior to redepositing the lifted constituents on the stationary grate. The mechanism for repeatedly moving the mobile grate employs a gearmotor and a parallel motion which is composed of followers movable along stationary tracks at the lateral sides of the screen and levers which are coupled to the mobile grate and to the followers and one of which receives motion from the motor. Alternatively, the levers are pivotable by a parallel motion which is driven by the motor by way of a crank or a feed screw.

23 Claims, 6 Drawing Sheets

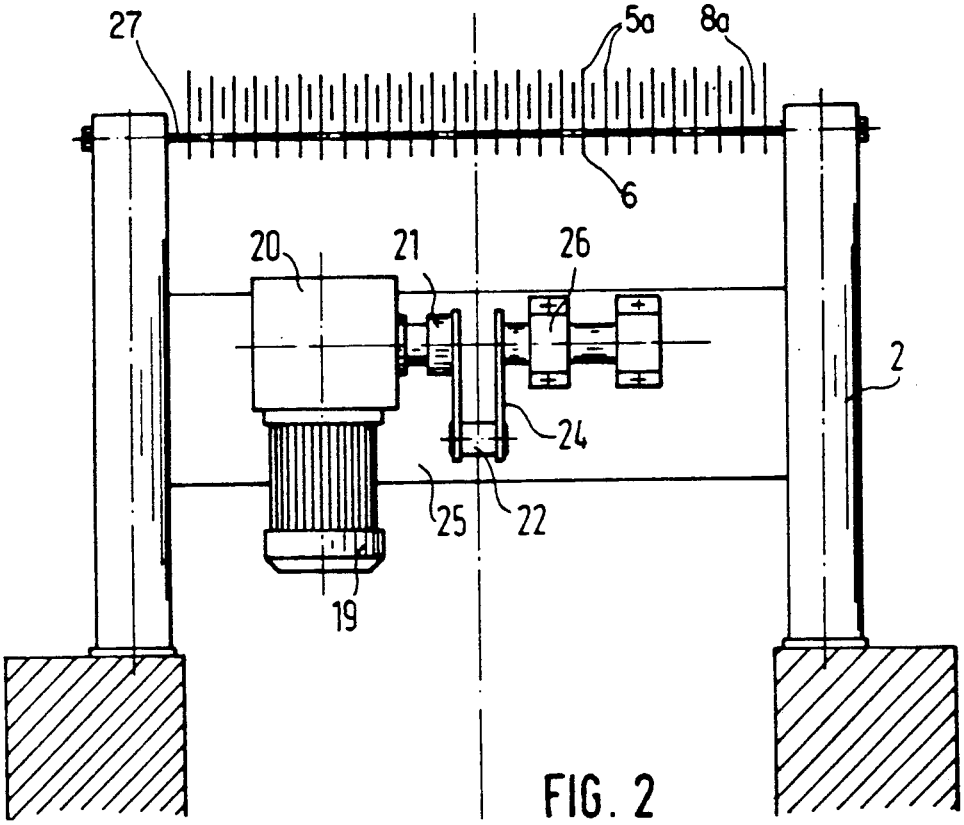
FIG. 2
FIG. 3
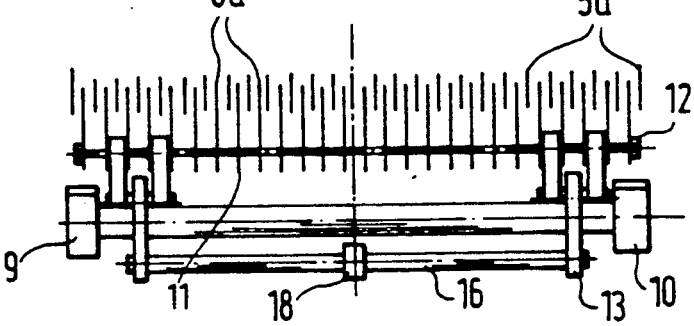

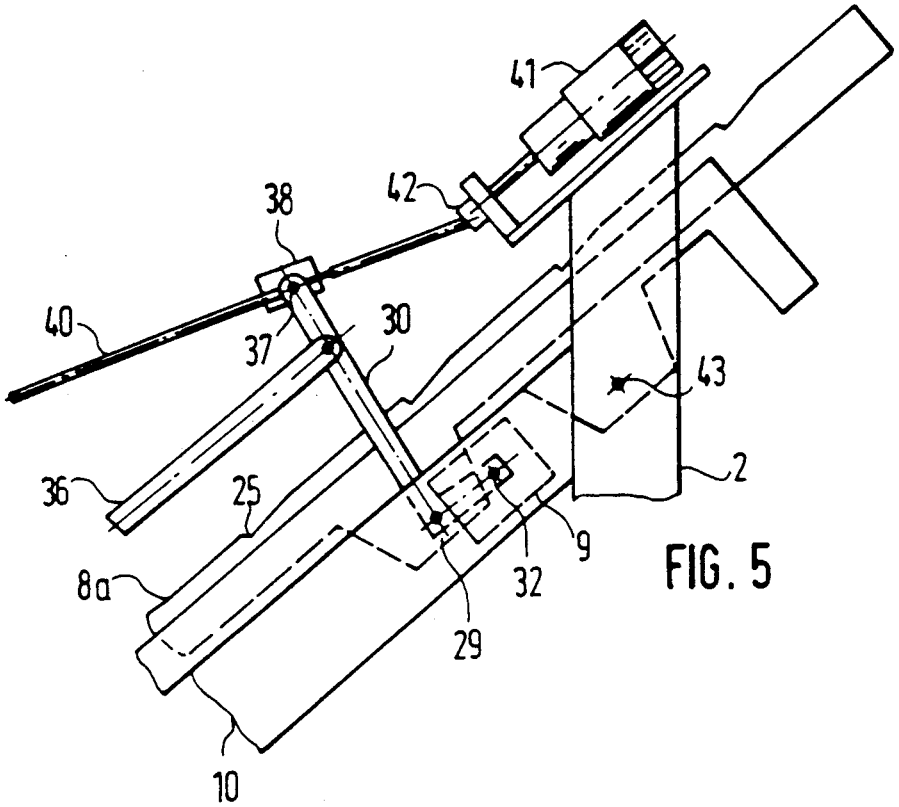
FIG. 5
FIG. 6
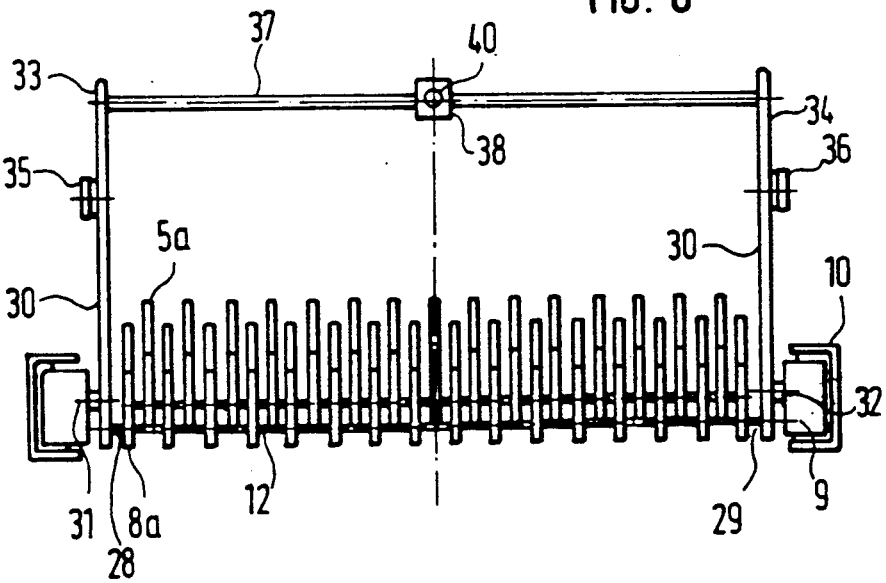

1
2
3
4
5
6
7
8
9
10
11
29
30
32
36
40
41
42
43
25
5a
8a
8c

MACHINE FOR INTERCEPTING SOLID CONSTITUENTS IN LIQUID STREAMS

BACKGROUND OF THE INVENTION

The invention relates to straining, screening or filtering machines in general, and more particularly to improvements in machines for intercepting solid constituents in liquid streams. For example, the machine of the present invention can be utilized to intercept and remove solid debris and/or other solid constituents from flowing sewage.

It is already known to intercept solid constituents in liquid streams by placing a sloping screen into a body of flowing liquid in such a way that the lower end of the screen rests on the bottom of the liquid conveying channel and the upper end of the screen is located at a level above the body of liquid. The outer side of the screen faces counter to the direction of liquid flow therethrough, and the screen is assembled of two sections or grates each having a set of parallel grate bars extending from the lower end to the upper end of the screen. The grate bars of one grate alternate with the grate bars of the other grate. One of the grates is stationary, and the other grate is movable relative to the one grate forwardly (counter to the direction of liquid flow through the screen) to lift intercepted impurities off the grate bars of the stationary grate, thereupon upwardly to raise the lifted impurities toward or above the liquid level, and thereupon rearwardly or inwardly (in the direction of flow of the liquid stream). This results in stepwise lifting of intercepted impurities along the exposed side of the stationary grate.

The mechanism which is used to move the mobile grate longitudinally of the grate bars as well as transversely of the stationary grate (in and counter to the direction of liquid flow through the screen) in a presently known machine of the above outlined character comprises rollers which are secured to the mobile grate at each side of the screen and are compelled to move along tracks which are provided therefor in or on the frame of the straining machine. The tracks are defined by rails which are disposed at two different levels, and the mobile grate is caused to travel relative to the rails in response to actuation of one or more hydraulic or pneumatic motors. The arrangement is such that the rollers are caused to move forwardly and upwardly along switching devices and onto the upper rails during a first stage of a complete cycle in order to advance the grate bars of the mobile grate counter to the direction of liquid flow and forwardly beyond the bars of the stationary grate (in order to lift the intercepted solid constituents off the stationary grate) and thereupon upwardly (in order to move the lifted off constituents toward the upper end of the screen). When the rollers reach the upper ends of the upper rails, they drop onto the respective lower rails with attendant generation of pronounced noise. Moreover, and since the mobile grate is rather heavy, repeated impacts upon the lower rails contribute to extensive wear and shorten the useful life of the machine. The rollers thereupon descend along the lower rails to retract the mobile grate to its starting position as well as to move such grate rearwardly, i.e., the descending mobile grate is moved out of contact with intercepted solid constituents at the exposed side of the stationary grate.

Another drawback of the just discussed machine is that the lower rails and the switching device are located below the liquid level. Therefore, and particularly if the liquid is raw sewage which carries floating as well as submerged solid matter, submerged solid matter accumulates on the lower rails and in and on the switching devices to cause a jamming of the rollers or to compel the hydraulic or pneumatic prime mover or prime movers to exert a large force in order to move the rollers along their prescribed paths. Partial jamming (for example, at one side of the screen) can cause extensive deformation of the screen and/or of the rails and/or other (even more serious) damage to the machine or to certain of its parts.

Swedish Pat. No. 436 416 discloses a modified straining machine wherein the bars of the mobile grate are assembled into a rigid package, and such grate is moved along a path having at least one vertical component in order to ensure that the solid constituents which are lifted off the stationary grate will be moved to a higher level prior to being redeposited on the stationary grate. The path is an endless path, and the upper end of the mobile grate is suspended from eccentric discs. The discs are coupled to each other by chains and are driven by a motor. There is no lateral guidance of the mobile grate; therefore, movements of the suspended mobile grate are unpredictable. In addition, the extent of movability of the mobile grate is relatively small because the dimensions of the eccentric discs cannot be increased at will. Still further, the initial and maintenance cost of the patented apparatus are very high.

In accordance with a further prior proposal, the mobile grate is movable relative to the stationary grate by a hydraulic cylinder and piston unit which is suspended from an overhead trolley. The trolley is moved back and forth, in and counter to the direction of liquid flow, and the cylinder and piston unit moves the suspended grate up and down relative to the stationary grate. The sides of the mobile grate are provided with followers which track substantially elliptical cams in order to prevent undesirable changes in orientation of the mobile grate. The just described straining machine exhibits the drawback that the mechanism for guiding, supporting and moving the mobile grate is very complex, expensive and prone to malfunction.

OBJECTS OF THE INVENTION

An object of the invention is to provide a straining machine which is not only simpler and less expensive but also sturdier than heretofore known machines.

Another object of the invention is to provide a straining machine the operation of which is substantially noiseless or which, at the very least, generates much less noise than heretofore known machines.

A further object of the invention is to provide the machine with novel and improved means for effecting displacements of the mobile section of the screen relative to the stationary section.

An additional object of the invention is to provide a machine which is constructed and assembled in such a way that the mechanism for displacing the mobile section of the screen is less likely to be affected by solid constituents in the liquid to be filtered than in heretofore known machines.

Still another object of the invention is to provide a machine wherein the mobile section of the screen is less likely to jam than in conventional machines.

A further object of the invention is to provide a machine which can stand long periods of uninterrupted use and wherein all parts, inclusive of the stationary section of the screen, are readily accessible with little loss in time and can be returned to their operative positions in a simple and time-saving operation.

An additional object of the invention is to provide a straining machine wherein the components of the stationary and mobile sections of the screen can retain intercepted constituents of sewage or other solid-containing liquids with a higher degree of reliability and predictability than in heretofore known machines.

A further object of the invention is to provide a machine wherein the extent of mobility of the mobile section of the screen relative to the stationary section can be selected practically at will without risking any (or any appreciable) intensification of noise and/or more pronounced wear upon the parts of the machine.

Another object of the invention is to provide a machine wherein the inclination of the screen can be selected and adjusted at will and within a wide range with little loss in time.

SUMMARY OF THE INVENTION

The invention resides in the provision of a straining or screening machine which serves for interception of solid constituents in a stream of liquid, for example, to intercept solid impurities in a stream of liquid sewage. The improved machine comprises a frame and a sloping composite screen which is mounted in the frame and has a lower end immersible into the liquid stream, an upper end which is held at a level above the liquid stream when the machine is in actual use, and first and second lateral sides which extend between the upper and lower ends. The screen comprises a stationary first section or grate with first elongated solids-intercepting components (e.g., grate bars) which extend between the upper and lower ends of the screen, and a mobile second section or grate with second elongated solids-intercepting components (e.g., grate bars) extending between the upper and lower ends of the screen and alternating with the first components. The machine further comprises means for moving the second section relative to the first section along a predetermined path including a movement outwardly beyond the first section so that the second components lift intercepted solid constituents off the first components, thereupon a movement toward the upper end of the screen in order to advance the lifted off constituents upwardly and along the outer side of the first section, and thereafter a movement inwardly to redeposit the lifted solid constituents on the first components but at a level higher than the earlier level of such constituents. The moving means comprises tracks which are provided on the frame along the two sides of the screen, reciprocable followers in the tracks, levers which are pivotably connected to the followers and to the second section of the screen at the respective sides of the screen, and means for pivoting the levers relative to the respective followers. The pivoting means can comprises at least one electric motor, particularly a gearmotor.

The moving means can comprise a plurality of spaced apart followers in each of the two tracks, and such moving means can further comprise means for connecting each follower in one of the tracks with a follower in the other track.

The pivoting means can comprise a prime mover (such prime mover can include or constitute the aforementioned electric motor) and a parallel motion which is connected between the prime mover and the levers. The pivoting means of such machine can further comprise a crank drive which is connected between the prime mover and the parallel motion. The crank drive can comprises a crank pin which is driven by the prime mover and a connecting rod between the crank pin and the parallel motion.

Each lever can comprise a first arm which is connected with the second section of the screen and a second arm which is connected with the parallel motion. The first and second arms of at least one of the levers can make an angle which equals or approximates 90°.

The second section of the screen can further comprise at least two crossbars or traverses which are connected to and extend transversely of the second components. One of the crossbars is nearest to the upper end and the moving means is connected to such one crossbar.

The prime mover of the pivoting means is or can be carried by the frame, and the parallel motion which connects the prime mover with the levers can comprise a first link which is disposed beneath the screen (namely at that side of the screen which faces in the direction of flow of the liquid stream through and beyond the screen) and extends in a direction from one end toward the other end of the screen. Such parallel motion further comprises at least one second link which extends transversely of the first and second components and connects the first link with the levers.

At least some of the components can be provided with means for promotion retention of solid constituents by the respective components. For example, the first components can have substantially smooth solids-intercepting surfaces, and the promoting means can include notches which are provided in some or all of the second components to impart to the respective components a sawtoothed or zig-zag shaped configuration.

In lieu of the aforementioned crank drive, the means for transmitting motion from the prime mover of the pivoting means to the parallel motion (which rocks the levers of the moving means) can comprise a male threaded element and a female threaded element which mates with the male threaded element. One of these elements is connected with the parallel motion, and the other threaded element is connected to and is rotatable by the prime mover. The male threaded element can include an externally threaded spindle (feed screw).

The levers of the moving means can include a plurality of levers at each side of the screen, and the parallel motion between the prime mover and the levers can include a first link which is articulately connected with the levers at one side of the screen, a second link which is articulately connected with the levers at the other side of the screen, and a third link which extends substantially transversely of the first and second components and connects a lever at one side with a lever at the other side of the screen.

In accordance with a presently preferred embodiment, the moving means comprises an elongated follower in each of the two tracks and a plurality of levers pivotally connected to each of the two elongated followers. The followers and the levers together constitute a parallel motion which connects the pivoting means with the second section of the screen. The first and second components of the screen have front sides which face counter to the direction of flow of the liquid stream when the screen is properly positioned relative to the stream so that the first and second components can intercept solid constituents, e.g., debris or the like. At least one of the two elongated followers can include two spaced apart stops, and one of the levers which are pivotally connected to the one elongated follower has a portion which is disposed between the stops to limit the extent of pivotability of the levers relative to the respective followers and the extent of movability of the second section of the screen relative to the first section.

The pivoting means can comprise a prime mover which transmits motion to a crank drive and the latter transmits motion to the parallel motion (including the two elongated followers) by way of a connecting rod. The second section of the screen can further comprise a plurality of crossbars which are connected to and extend substantially transversely of the second components. The crossbars are spaced apart from each other in the longitudinal direction of the first and second components, and the second section of the screen receives motion from the parallel motion by way of at least one of these crossbars. The levers include means for imparting to the second section of the screen movements longitudinally as well as substantially transversely of the first components.

The machine can further comprise means for pivotally connecting the screen to the frame. The connecting means preferably defines a pivot axis which is located at the upper end of the screen, and the latter is pivotably about such axis to move its lower end into and above the liquid stream.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 2 is an end elevational view of the upper portion of the machine as seen from the left-hand side of FIG. 1;

FIG. 3 is an end elevational view of the lower portion of the machine as seen from the left-hand side of FIG. 1, the mobile section being shown in a raised position in which it extends forwardly beyond the stationary section;

FIG. 5 is an enlarged view of a detail in the upper portion of FIG. 4, with the parallel motion of the means for moving the mobile section in a different position;

FIG. 6 is a front elevational view of the upper portion of the second machine as seen from the left-hand side of FIG. 4 or 5;

FIG. *7a* is a fragmentary side elevational view of a component of the first section and a component of the second section of the screen during downward movement of the second section;

FIG. *7b* shows the components of FIG. *7a* but with the component of the second section of the screen in its lower end position;

FIG. *7c* shows the components of FIGS. *7a* and *7b* during upward movement of the second section;

FIG. *7d* is a front elevational view of several first and second components, with the second components assuming positions corresponding to that of the second component of FIG. *7a;*

FIG. *7e* is a front elevational view of several first and second components, with the second components assuming positions corresponding to that of the second component which is shown in FIG. *7b;*

FIG. *7f* is a front elevational view of several first and second components, with the second components assuming positions corresponding to that of the second component which is shown in FIG. *7b;*

FIG. *7f* is a front elevational view of several first and second components, with the second components assuming positions corresponding to that of the second component of FIG. *7c;*

Figures 8, 9, 9A:
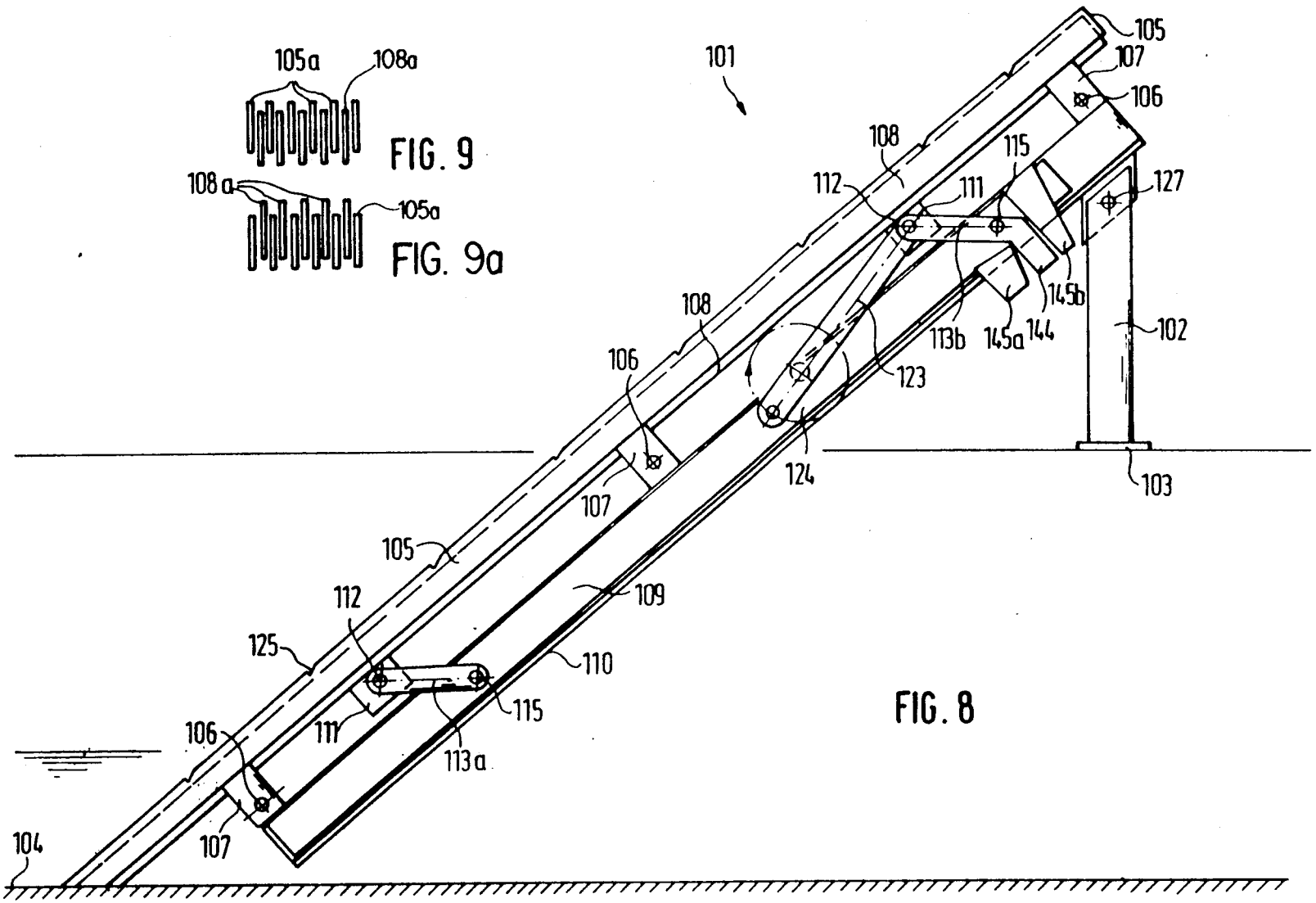
Figure 10:
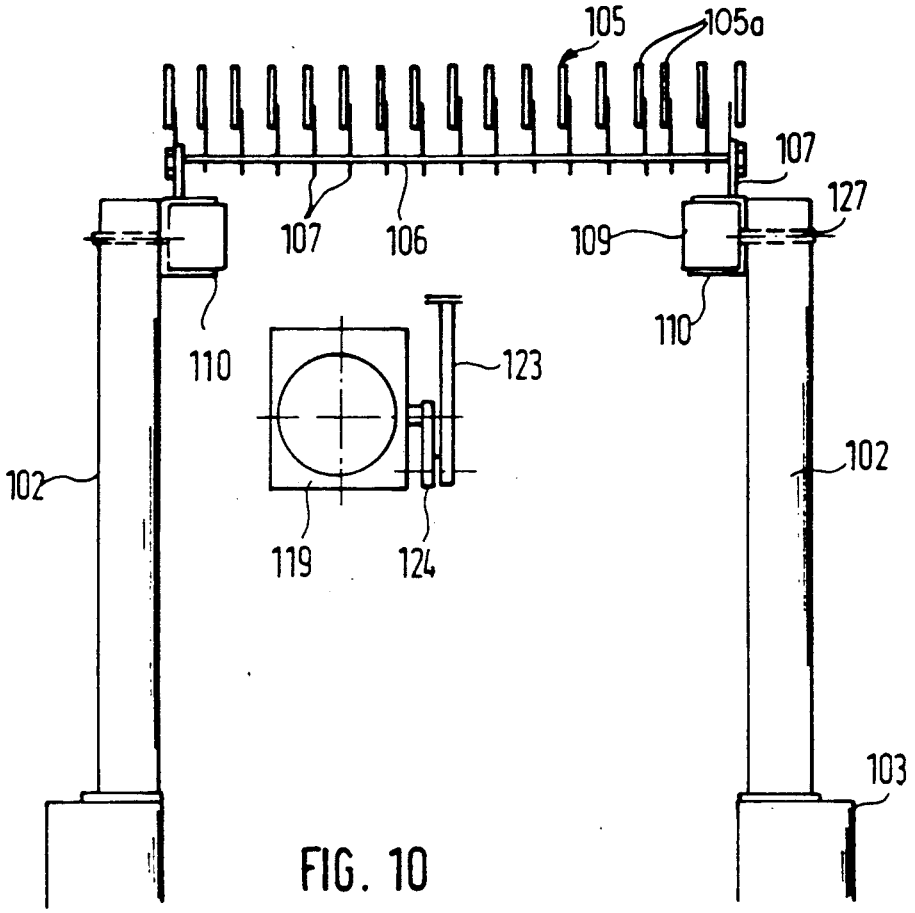
Figure 11:
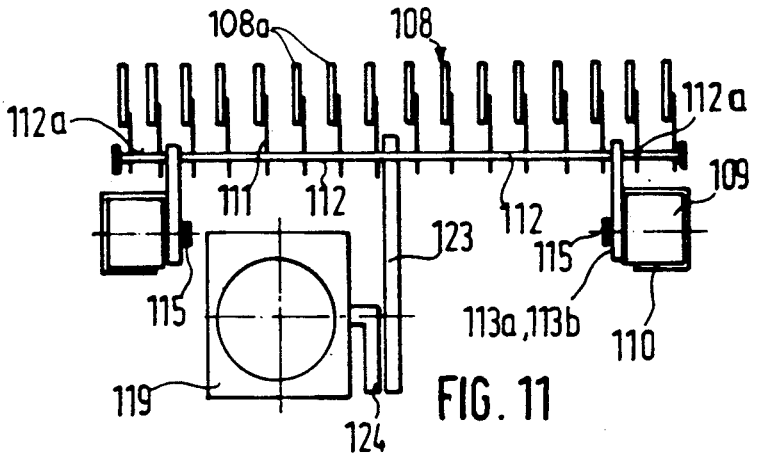

FIG. 8 is a schematic side elevational view of a third machine wherein the levers and elongated followers of the means for moving the mobile section of the screen together constitute a parallel motion for the second section;

FIG. 9 shows the first and second components of the screen sections in the machine of FIG. 8, the second components being shown in retracted positions behind the first components;

FIG. *9a* shows the structure of FIG. 9 but with the second components in extended positions;

FIG. 10 is a schematic rear elevational view of the upper portion of the third machine; and FIG. 11 is a schematic front elevational view of the upper portion of the third machine.

DESCRIPTION OF PREFERRED EMBODIMENTS

Figure 1:
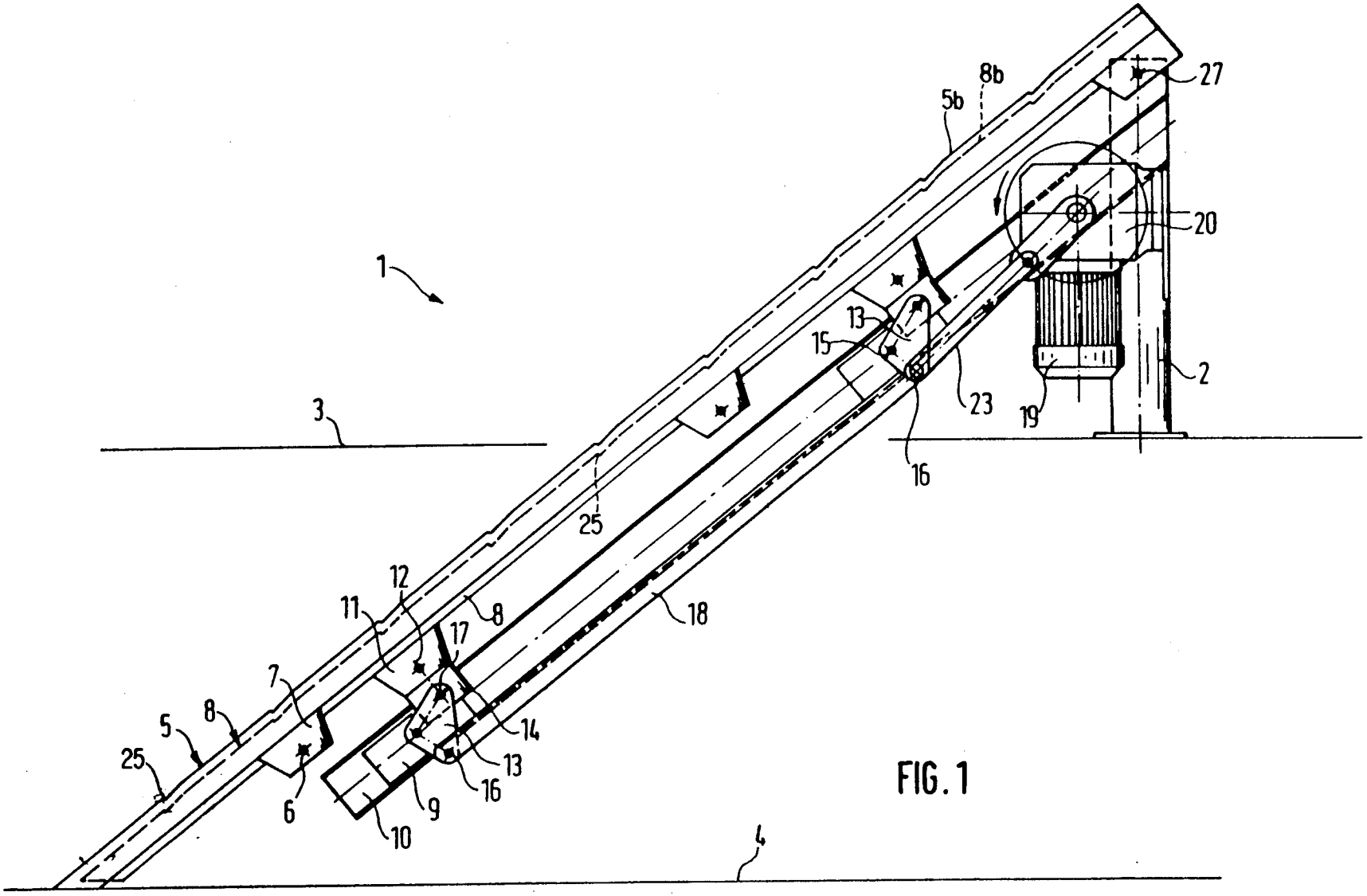
FIG. 1 is a schematic side elevational view of a straining machine which embodies one form of the invention and wherein the means for moving the mobile section of the screen includes a crank drive, the mobile section being shown in a retracted position slightly behind the stationary section.

The straining machine 1 which is shown in FIGS. 1 to 3 comprises a frame including two upright frame members or posts 2 positionable on the two banks 3 of a channel for a stream of liquid which contains solid constituents. For example, the liquid can consist of raw sewage which contains solid debris. The debris can be partly or fully immersed in or can float on the surface of the liquid stream which flows in a direction to the right, as seen in FIG. 1. The frame supports a composite screen or filter including a normally stationary section or grate 5 and a mobile section or grate 8. The lower end of the screen rests on the bottom wall 4 of the channel between and at a level below the banks 3, and the upper end of the grate 5 of the screen is pivotally connected to the upper end portions of the frame members 2, as at 27, so that the grate 5 can be pivoted about a transversely extending horizontal axis which enables the operators or a crane or the like to change the inclination of the grate 5 or to lift the entire grate 5 out of the channel, e.g., to move the lower end of the grate 5 to or above the level of the banks 3.

The grate 5 of the screen includes a set of elongated parallel first components 5*a* (e.g., grate bars made of a metallic material) which extend from the lower end to the upper end of the screen. The components 5*a* are maintained in the illustrated positions relative to each other by crossbars 6 which extend through inwardly and downwardly extending lugs 7 provided on each component 5*a* (see FIG. 2). The uppermost crossbar of the stationary grate 5 can constitute the pivot means or fulcrum 27 at the upper ends of the frame members 2.

The mobile section or grate 8 of the screen comprises elongated parallel second components or grate bars 8*a* which also extend from the lower end to the upper end of the screen and alternate with the components 5*a* of the grate 5 (see FIGS. 2 and 3). Each component 8*a* has two rearwardly extending projections or lugs 11 which are traversed by transversely extending crossbars 12 of the grate 8. FIG. 1 shows that the lugs 11 are offset relative to the lugs 7 in the longitudinal direction of the screen so that the grate 8 can perform a composite movement with reference to the grate 5 in order to advance any solid constituents which are intercepted by the exposed front or outer sides 5*b*, 8*b* of the two grates, namely to advance such solid constituents in stepwise fashion in a direction from the lower end toward and ultimately beyond the upper end of the screen. Successive increments of the layer of solid constituents which are raised by the mobile grate 8 can spill over the upper end of the screen to be collected in a vibrating trough (not shown) on a belt conveyor or in any other receptacle or the like.

The means for moving the grate 8 relative to the grate 5 along an endless path in such a way that the components 8*a* first move forwardly and upwardly (see FIGS. 7*c* and 7*f*) in order to lift solid constituents off the front side 5*b* and to thereupon move the thus lifted solid constituents in the direction of arrow 8*c* (FIG. 7*c*) comprises a prime mover 19 (preferably an electric gearmotor) which is mounted in the frame on a plate-like support 25. The moving means further comprises a step-down transmission 20 of any suitable design which has an input element driven by the prime mover 19 and an output element 21 serving to transmit torque to a crank drive having a crank pin 22 and crank cheeks 24. A bearing 26 for the crank drive including the pin 22 is secured to the plate-like support 25 for the prime mover 19 and transmission 20. Still further, the means for moving the grate 8 comprises a connecting rod 23 which is coupled to the crank pin 22 and transmits motion to an upper transversely extending link 16 forming part of a parallel motion. The latter further includes a second or lower link 16 which is parallel to the link 16 and a third link 18 between the two links 16. The links 16 and 18 are located behind the screen including the grates 5, 8, the links 16 extend transversely of the components 5*a* and 8*a*, and the link 18 extends longitudinally of the components 5*a*, 8*a*.

The means for moving the grate 8 still further comprises two pairs of relatively short block- or roller-shaped followers 9. The followers 9 of each pair are aligned with each other and are reciprocable in a discrete elongated track 10 having a substantially U-shaped cross-sectional outline and extending at the respective lateral side of the screen including the grates 5 and 8. Each follower 9 is articulately connected with the grate 8 at the respective lateral side of the screen by a discrete lever 13 having a substantially triangular outline and constituting a bell crank with two arms which are disposed substantially or exactly at right angles to each other. The free end of one arm of each lever 13 is pivotally connected to the adjacent lug or lugs 11 by a horizontal pivot pin 17 which extends transversely of the components 5*a* and 8*a*. Each lever 13 is pivotable on the respective follower 9 about the axis of a horizontal pivot pin 15 which is parallel to the pivot pins 17, and the free end of the other arm of each lever 13 is pivoted to the respective link 16. Each of the links 16 can constitute a rod, and the link 18 can constitute an elongated strip or bar of metallic or other suitable material. The outermost projections or lugs 12 of each set of transversely aligned lugs 12 are provided with rearwardly projecting extensions 14 (two can be seen at each longitudinal end of the crossbar 12 which is shown in FIG. 3), and each pair of extensions 14 flanks the adjacent arm of the respective triangular lever 13.

An advantage of the machine 1 which is shown in FIGS. 1 to 3 is that the means for moving the mobile grate 8 of the screen need not employ a reversible prime mover, i.e., the motor 19 can be designed to drive the output element 21 of the step-down transmission 20 in a single direction.

FIG. 1 shows the mobile section 8 of the screen in its starting position. The front side 8*b* of this grate is located slightly behind the front side 5*b* of the stationary grate 5 so that solid constituents which are delivered by the liquid stream above the bottom wall are intercepted primarily or exclusively by the grate bars 5*a*. If the operator or operators consider it necessary, the grate 5 can be pivoted about the axis of the pivot means 27 to afford more convenient access to the grate 8 and to other parts (such as the tracks 10, followers 9, levers 13 and parallel motion 16, 18 behind the grate 8). Such pivoting of the grate 5 simplifies the inspection, repair and maintenance work.

As already mentioned above, the purpose of the mobile grate 8 is to advance intercepted solid constituents along the front side 5*b* of the grate 5 in a direction toward and ultimately beyond the upper end of the screen. The motor 19 is set in operation (e.g., by an adjustable timer or by hand) at selected intervals so that, during the first stage of each operation of the motor, the crank pin 22 pulls the connecting rod 23 and the link 18 of the parallel motion upwardly and to the right (as seen in FIG. 1). In other words, the links 16 of the parallel motion are caused to move nearer to the prime mover 19. The parallel motion including the links 16 and 18 pivots the levers 13 in a counterclockwise direction (about the axes of the respective pivot members 15) whereby the pivot members 17 cause the extensions 14, the links 11 and the crossbars 12 to move forwardly and upwardly and to move the front side 8*b* of the grate 8 outwardly beyond the front side 5*b* of the grate 5. At the same time, the pivoting levers 13 cause the grate 8 to perform a movement toward the upper end of the grate 5 (i.e., toward the upper ends of the frame members 2). This causes the components 8*a* to lift solid constituents off the front sides of the grate bars 5*a* and to thereupon advance the thus lifted solid constituents by a step toward the upper end of the screen. As the levers 13 continue to pivot in a clockwise direction (reference being had to FIG. 1), the grate 8 begins to move toward the position of FIG. 1 and deposits solid constituents at the front side 5*b* of the stationary grate 5. At such time, the followers 9 slide downwardly along the respective tracks 10 which enables the levers 13 to reassume the angular positions of FIG. 1 as soon as the crank pin 22 completes an orbital movement along a complete circle (360°). All of the solid material which has been lifted off the front side 5*b* and raised by a step toward the upper end of the screen 5+8 is redeposited on the front side 5*b* not later than when the output element 21 of the step-down transmission 20 completes a full revolution in a counterclockwise direction, (as viewed in FIG. 1). The prime mover 19 is then arrested and remains at a stand-still for a selected interval of time. The same operation is then repeated again and again with the resulting stepwise migration of intercepted solid constituents toward and beyond the upper end of the screen. The followers 9 assume and dwell in their lower end positions when the prime mover 19 is idle, i.e., when the grate 8 is caused to remain in the starting or retracted position of FIG. 1.

The parallel motion can be simplified by omitting the link 18 if the two followers 9 which are shown in FIG. 1 and/or the other two followers 9 (at the other lateral side of the screen) are connected to each other by one or more parts (not shown) which maintain the followers in each of the two tracks 10 (or in at least one of the tracks) at a fixed distance from each other. Moreover, it is then possible to replace the two lower levers 13 with simpler one-armed levers or links each of which is articulately connected to the respective (lower) follower 9 and to the adjacent lateral side of the mobile grate 8.

Figures 4, 7A, 7B, 7C, 7D, 7E, 7F:
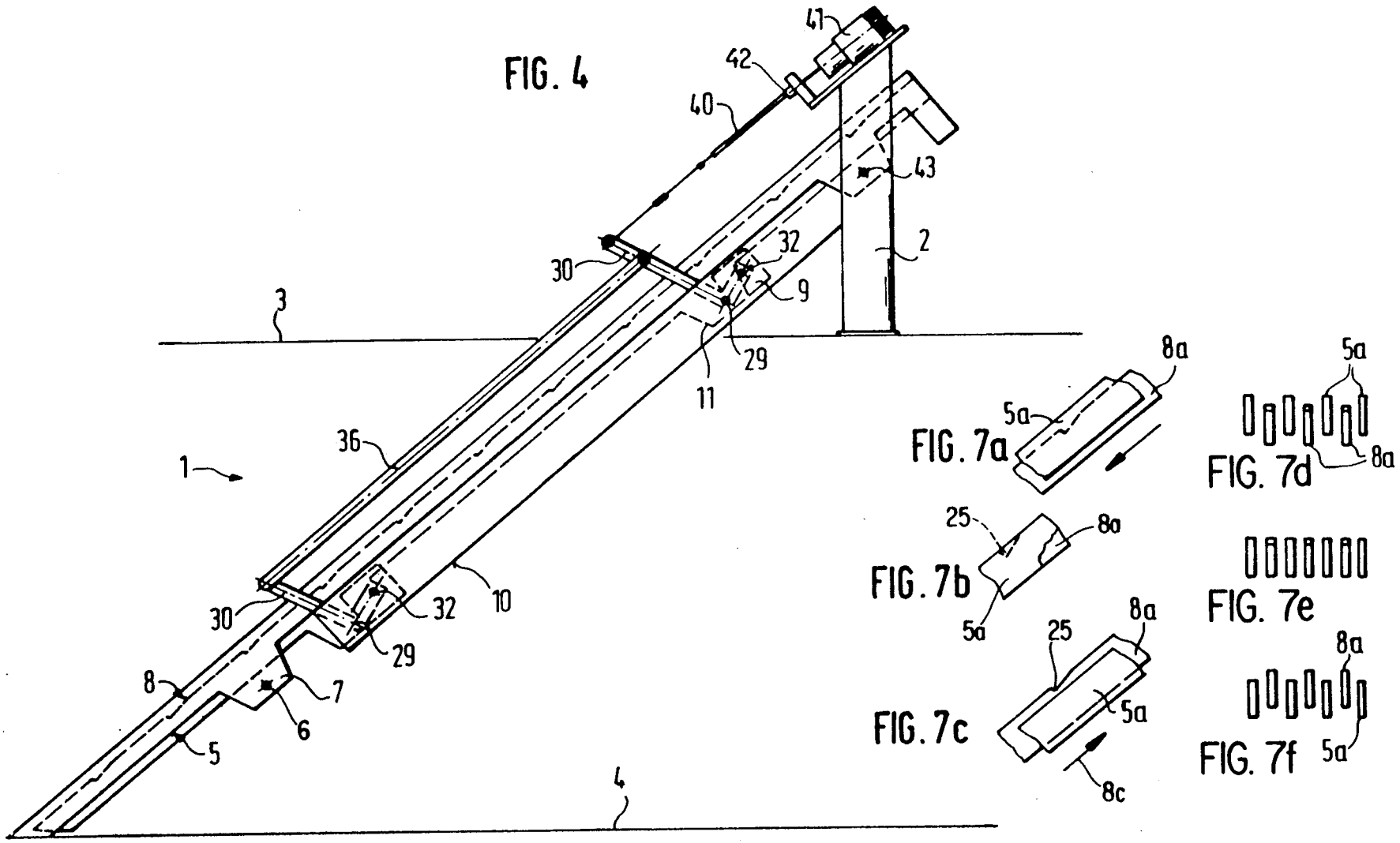
FIG. 4 is a fragmentary schematic side elevational view of a second machine wherein the means for moving the mobile section of the screen comprises an externally threaded spindle.

The (second) machine of FIGS. 4 to 6 constitutes a first modification of the machine 1 of FIGS. 1 to 3. All such parts of this second machine which are identical with or clearly analogous to the corresponding parts of the machine 1 of FIGS. 1-3 are denoted by similar reference characters. The section or grate 5 of the composite two-section screen is indirectly mounted on the upright frame members 2 (as at 43). The means for moving the second section or grate 8 relative to the grate 5 comprises a reversible electric motor 41 and a motion transmitting unit including two mating threaded elements 38, 40, namely a female element or nut 38 and a male element in the form of a spindle 40 mating with the nut and receiving torque from the motor 41 by way of a universal joint 42. The moving means further comprises a modified parallel motion including two elongated links 35 and 36 extending in substantial parallelism with the grate bars or components 5*a*, 8*a* and a third link 37 which extends transversely of the links 35, 36 and is connected with the free ends of the longer arms 33, 34 of the two upper bell crank levers 30 each of which is substantially L-shaped. The shorter lower arms of the levers 30 (four of them are used in the moving means for the grate 8 of FIGS. 4-6) are pivotally connected to the respective followers 9 by transversely extending horizontal pins 31 or 32. The levers 30 are pivotably mounted on the end portions 28 and 29 of the respective crossbars 12, i.e., they are mounted on the mobile grate 8 because the crossbars 12 extend through lugs 11 projecting rearwardly and downwardly from the adjacent components 8*a*.

The link 37 of the parallel motion is connected with the upper ends of the longer arms 33, 34 of the two upper levers 30, and the median portion of the link 37 carries the aforementioned nut 38 which mates with the spindle 40. The universal joint 42 enables the spindle 40 to change its inclination when it is rotated by the motor 41 to pivot the levers 30 by way of the parallel motion 35-37 and to thereby move the grate 8 relative to the grate 5 for the same purpose and in substantially the same way as described with reference to the machine 1 of FIGS. 1 to 3.

The front side of each component 8*a* is provided with a series of spaced apart notches 25 which serve to promote retention of solid constituents during lifting of such constituents off the smooth or substantially smooth front sides of the grate bars or components 5*a*. Reference may also be had to FIGS. 7*a* to 7*c*. However (and as actually shown in FIG. 1), it is equally possible to provide notches 25 or similar recesses in the front sides of the components 5*a* and 8*a* to even further reduce the tendency of intercepted solid constituents to slide along the front sides 5*a*, 8*a* in a direction toward the lower end of the screen. The notches 25 impart to the respective front sides a serrated or sawtooth-shaped configuration.

The tracks 10 of the moving means in the apparatus of FIGS. 4 to 6 are rigid with the grate 5 and are pivotable relative to the frame members 2 about a common horizontal axis, as at 43. Thus, the machine of FIGS. 4 to 6 is designed in such a way that the grates 5 and 8 can be pivoted as a unit between the operative positions of FIG. 4 and inoperative positions in which the entire screen is located above the liquid level in the channel including the bottom wall 4 and the banks 3. Pivoting of the screen 5+8 to the raised or inoperative position is advantageous for the purposes of maintenance, inspection, repair or other work upon the grates and/or on the means for moving the grate 8 relative to the grate 5.

The prime mover 41 of the machine 1 of FIGS. 4 to 6 is preferably set in operation at selected intervals. When the prime mover 41 is started, it rotates the spindle 40 in a clockwise direction (as seen in FIG. 6) whereby the nut 38 advances toward the prime mover and trains the link 37 in the same direction. The longer arms of the levers 30 are moved toward the prime mover 41 (i.e., the levers 30 pivot in a clockwise direction, as seen in FIG. 4 or 5) and cause the corresponding crossbars 12 to move the grate 8 upwardly and outwardly beyond the grate 5. At the same time, the grate bars 8*a* move upwardly toward the prime mover 41 so that they lift solid constituents off the front sides of the grate bars 5*a* and thereupon move the thus lifted solid constituents in the direction of arrow 8*c* (FIG. 7*c*). The next stage of pivotal movement of the levers 30 in a clockwise direction entails a retraction of the components 8*a* so that the raised solid constituents are redeposited on the components 5*a* but a step closer to the upper end of the screen. The followers 9 slide in the respective tracks 10 during upward movement of the components 8*a*.

FIG. 5 shows the grate 8 in the uppermost position relative to the stationary grate 5. The prime mover 41 is then arrested and is started in the opposite direction so that the spindle 40 rotates in a counterclockwise direction and compels the link 37 of the parallel motion 35-37 to move away from the prime mover. The components 8*a* are moved from the extended positions of FIGS. 7*c* and 7*f*, through the median or intermediate positions of FIGS. 7*b* and 7*e*, to the retracted or starting positions which are shown in FIGS. 7*a* to 7*d*. The followers 9 slide downwardly along the respective tracks 10 and reassume the lower end positions of FIG. 4. The prime mover 41 is arrested and remains idle for the selected interval of time. The same mode of operation is repeated as long and as often as necessary when the intercepted solid constituents "creep" along the front sides of the components 5*a* toward and beyond the upper end of the screen to be collected in a receptacle (not shown) or to be transported away by a suitable conveyor.

FIGS. 8 to 11 show certain details of a third machine 101 wherein the means for moving the mobile section or grate 108 of the screen relative to the stationary section or grate 105 comprises two pairs of modified levers 113*a*, 113*b* which, together with elongated followers 109, constitute a parallel motion serving to move the screen section or grate 108 in response to operation of a prime mover in the form of an electric gearmotor 119. The upper ends of the elongated guides or tracks 110 for the followers 109 at the lateral sides of the screen 105+108 are pivotally connected to the frame members or posts 102 by transversely extending horizontal pins or shafts 127, and the stationary screen section or grate 105 is mounted on the tracks 110 so that it can share the pivotal movements of the tracks about the common axis of the shafts 127. The lower end of the grate 105 rests on the bottom wall 104 of a channel for a stream of solids-containing liquid (e.g., raw sewage) which flows in a direction to the right (as seen in FIG. 8) between the banks 103. The lower ends of the frame members 102 are supported by the respective banks 103.

The grate 105 comprises a set of preferably equidistant elongated parallel grate bars 105*a* which extend from the lower end to the upper end of the screen, and these grate bars alternate (see FIGS. 9 and 9*a*) with the elongated grate bars 108*a* of the mobile grate 108. The grate bars 105*a* are connected to each other by crossbars 106 (see particularly FIG. 10) which extend through rearwardly and inwardly extending links 107 of the grate bars 105*a*. At least the front sides of the grate bars 105*a* are provided with notches 125 which promote retention of intercepted solid constituents while the liquid fraction of the stream flows between the grate bars 105*a*, 108*a* in a direction from the left-hand side to and beyond the right-hand side of the two-grate screen 105+108.

The guides or tracks 110 are adjacent the lateral sides of the screen and guide the respective elongated followers 109 each of which pivotably supports a lower lever 113*a* and an upper lever 113*b*. The tracks 110 have a substantially U-shaped cross-sectional outline (see FIG. 10). The rearwardly and inwardly extending lugs 111 of the grate bars 108*a* are connected to each other by several crossbars 112, and the lowermost crossbar 112 serves as a pivot member for the lower levers 113*a*. The levers 113*a*, 113*b* are further connected to the respective tracks 110 by pivot pins 115. The illustrated crossbars 112 are elongated rods having a circular cross-sectional outline. The levers 113*a*, 113*b* are pivotable on the end portions 112*a* of the respective crossbars 112 (see FIG. 11).

The longer arms of the upper levers 113*b* are connected to and can be pivoted by a connecting rod 123 to thereby move the elongated followers 109 relative to the respective tracks 110. Thus, the levers 113*b* convert the orbital movements of the upper end of the connecting rod 123 (as seen in FIG. 8) into reciprocatory movements of the followers 109. Each lever 113*b* is a bell crank having a longer upper arm which is coupled to the connecting rod 123 and a shorter lower arm or portion 144 extending with play between two spaced-apart abutments or stops 145*a*, 145*b* on the respective elongated follower 109.

The connecting rod 123 receives motion from the pin 124 of a crank drive which, in turn, receives motion from the prime mover 119 by way of a suitable step-down transmission (not shown) corresponding to the transmission 120 of the machine 1 which is shown in FIGS. 1 to 3.

When the prime mover 119 is started, the crank pin 124 moves the connecting rod 123 to pivot the levers 113*b*. The levers 113*b* pivot about the respective members 115 and cause the levers 113*a* to pivot about the respective members 115 which are fixed to the tracks 110. This causes the grate bars 108*a* of the mobile grate 108 to move forwardly and outwardly as well as upwardly in order to lift solid constituents off the grate bars 105*a* and to advance the thus lifted solid constituents toward the upper end of the screen 105+108. Pivoting of the levers 113*b* in a clockwise direction (as seen in FIG. 8) is terminated when their portions or arms 144 reach and are arrested by the respective stops 145*b*. As the connecting rod 123 continues to move, the levers 113*b* act upon the respective stops 145*b* and cause the followers 109 to slide in the respective tracks 110 toward the upper end of the screen.

The connecting rod 123 thereupon causes the levers 113*b* to pivot in the opposite direction and to retract the grate bars 108*a* so that the raised solid constituents are deposited on the grate bars 105*a*. The lever portions or arms 144 move toward the respective stops 145*a* and cause the followers 109 to slide downwardly so that the grate bars 108*a* are returned to the retracted positions of FIG. 8. The prime mover 119 is arrested when the crank pin 124 completes an orbital movement along an arc of 360°. The same procedure is repeated when the prime mover 119 is restarted. The intercepted solid constituents are raised in stepwise fashion and ultimately advance beyond the upper end of the screen to be collected or transported away in a manner not forming part of the present invention. The operation of the prime mover 119 can be controlled by an automatic timer which sets the crank pin 124 in motion at regular or irregular intervals.

When necessary, the grates 105, 108 can be lifted out of the liquid stream by the simple expedient of pivoting the tracks 110 about the common axis of the shafts 127, i.e., relative to the frame members 102.

An important advantage of the improved machine is its simplicity. Moreover, the solid constituents in or on the liquid stream are much less likely to interfere with the relatively small pivotal movements of the levers 13, 30 or 113*a*, 113*b* than with movements of rollers in cam grooves or the like. Still further, the improved machine generates little noise and the rate of stepwise raising of intercepted solid constituents can be selected practically at will.

The machine 101 is even less likely to jam than the machines 1 of FIGS. 1–3 and 4–6 because the angular movements of the lower levers 113*a* are only in the range of a few degrees. Therefore, the levers 113*a* can be immersed in the liquid stream without risking obstruction of their pivotal movements by the oncoming solid constituents in or on the liquid stream. The length of stepwise upward movements of intercepted solid constituents is determined by the throw of the crank pin 124. The upper levers 113*b* not only move the grate 108 transversely of the grate 105 but also move the grate 108 (through the medium of the elongated followers 109) toward or away from the upper end of the screen.

The operation of the machine 1 or 101 is not affected, or is not unduly affected, by the raising or descending level of the liquid stream in the channel between the banks 3 or 103 and/or by fluctuations of the percentage of solid constituents in the liquid stream. The reciprocable followers 9 or 109 are capable of pushing the adjacent solid constituents out of the way so that they remain reciprocable in the respective tracks 10 or 110.

The absence of noise, or of any appreciable noise, when the machine 1 or 101 is in actual use is due to the fact that the followers 9 or 109 merely reciprocate in the respective tracks 10 or 110 but need not abruptly descend from a higher level to a lower level as in certain presently known machines. Moreover, the parts of various parallel motions must perform relatively short movements in order to pivot the respective sets of levers (13, 30 or 113*a*, 113*b*) through angles which are necessary to ensure that the grate bars 8*a* or 108*a* can perform the required outward, upward, inward and downward movements with reference to the stationary grate bars 5*a* or 105*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A straining machine for interception of solid constituents in a stream of liquid, such as sewage, comprising a frame; a sloping composite screen mounted in said frame and having a lower end immersible into the liquid stream, an upper end arranged to be held at a level above the liquid stream, and first and second lateral sides extending between said ends, said screen comprising a stationary first section with first elongated solids-intercepting components extending between said ends and a mobile second section with second elongated solids-intercepting components extending between said ends and alternating with said first components; and means for moving said second section relative to said first section along a predetermined path including a movement outwardly beyond said first section so that the second components lift intercepted constituents off the first components, thereupon a movement toward said upper end and thereafter a movement inwardly to redeposit lifted constituents on said first components, said moving means comprising tracks provided on said frame along the sides of said screen, reciprocable followers in said tracks, levers pivotably connected to said followers and to said second section at the respective sides of said screen, and means for pivoting said levers relative to the respective followers.

2. The machine of claim 1, wherein said pivoting means comprises an electric motor.

3. The machine of claim 2, wherein said motor is a gearmotor.

4. The machine of claim 1, wherein said moving means comprises a plurality of spaced apart followers in each of said tracks.

5. The machine of claim 4, wherein said moving means further comprises means for connecting each follower in one of said tracks with a follower in the other of said tracks.

6. The machine of claim 1, wherein said pivoting means comprises a prime mover and a parallel motion connected between said prime mover and said levers.

7. The machine of claim 6, wherein said pivoting means further comprises a crank drive connected between said prime mover and said parallel motion.

8. The machine of claim 7, wherein said crank drive comprises a crank pin driven by said prime mover and a connecting rod between said crank pin and said parallel motion.

9. The machine of claim 6, wherein each of said levers comprises a first arm which is connected with said second section and a second arm which is connected with said parallel motion, said first and second arms making an angle which equals or approximates 90°.

10. The machine of claim 1, wherein said second section further comprises at least two crossbars connected to and extending transversely of said second components, one of said crossbars being nearest to said upper end and said moving means being connected with said one crossbar.

11. The machine of claim 1, wherein said pivoting means comprises a prime mover which is carried by said frame and a parallel motion which connects said prime mover with said levers, said parallel motion comprising a first link disposed beneath said screen and extending in a direction from one of said ends toward the other of said ends, and at least one second link extending transversely of said components and connecting said first link with said levers.

12. The machine of claim 1, wherein at least some of said components are provided with means for promoting retention of solid constituents by the respective components.

13. The machine of claim 12, wherein said first components have substantially smooth solids-intercepting surfaces and said promoting means includes notches provided in said second components.

14. The machine of claim 1, wherein said pivoting means comprises a prime mover, a parallel motion connected with said levers, and means for transmitting motion from said prime mover to said parallel motion including a male threaded element and a female threaded element mating with said male element, one of said elements being connected with said parallel motion and the other of said elements being rotatable by said prime mover.

15. The machine of claim 14, wherein said male element includes an externally threaded spindle.

16. The machine of claim 1, wherein said pivoting means comprises a prime mover and a parallel motion connecting said prime mover with said levers, said levers including a plurality of levers at each side of said screen and said parallel motion including a first link articulately connected with the levers at one of said sides, a second link articulately connected with the levers at the other of said sides, and a third link extending transversely of said components and connecting a lever at one of said sides with a lever at the other of said sides.

17. The machine of claim 1, wherein said moving means comprises an elongated follower in each of said tracks and a plurality of levers pivotally connected to each of said followers, said followers and said levers together constituting a parallel motion which connects said pivoting means with said second section.

18. The machine of claim 17 for interception of solid constituents in a stream which flows in a predetermined direction, wherein said components have outer sides arranged to intercept solid constituents and are constructed and arranged to face substantially counter to said direction when said lower end is immersed into and said upper end is held at said level above the liquid stream.

19. The machine of claim 17, wherein at least one of said followers includes two spaced apart stops and one of the levers which are pivotally connected to said one follower has a portion disposed with a predetermined clearance between said stops to limit the extent of pivotability of said levers relative to the respective followers and the extent of movability of said second section relative to said first section.

20. The machine of claim 17, wherein said pivoting means comprises a prime mover, a crank drive receiving motion from said prime mover, and a connecting rod which transmits motion from said crank drive to said parallel motion.

21. The machine of claim 17, wherein said second section further comprises a plurality of crossbars connected with and extending transversely of said second components, said crossbars being spaced apart from each other in the longitudinal direction of said components, said second section receiving motion from said parallel motion by way of at least one of said crossbars.

22. The machine of claim 17, wherein said levers include means for imparting to said second section movements longitudinally as well as substantially transversely of said first components.

23. The machine of claim 1, further comprising means for pivotally connecting said screen to said frame, said connecting means defining a pivot axis which is located at said upper end and said screen being pivotable about said axis to move said lower end thereof into and above the liquid stream.

* * * * *